US007174957B1

(12) United States Patent
Jokhio

(10) Patent No.: US 7,174,957 B1
(45) Date of Patent: Feb. 13, 2007

(54) MAGNETIC BAILER

(75) Inventor: Sarfraz A. Jokhio, Houston, TX (US)

(73) Assignee: Wood Group ESP, Inc., Oklahoma City, OK (US)

( * ) Notice: Subject to any disclaimer, the term of this patent is extended or adjusted under 35 U.S.C. 154(b) by 219 days.

(21) Appl. No.: 10/863,950

(22) Filed: Jun. 8, 2004

(51) Int. Cl.
*E21B 31/08* (2006.01)
*E21B 27/00* (2006.01)

(52) U.S. Cl. ..... 166/99; 166/66.5; 166/107; 175/308; 294/65.5

(58) Field of Classification Search ..... 166/66.5, 166/99, 105.1, 105.3, 107, 162; 175/308; 294/65.5
See application file for complete search history.

(56) References Cited

U.S. PATENT DOCUMENTS

| | | | | |
|---|---|---|---|---|
| 2,522,294 | A * | 9/1950 | Noble | 294/65.5 |
| 2,556,849 | A * | 6/1951 | Nolley et al. | 166/66.5 |
| 2,700,567 | A | 1/1955 | Fortenberry | |
| 2,789,790 | A * | 4/1957 | Kirby, II | 175/245 |
| 2,834,630 | A * | 5/1958 | Greer | 294/65.5 |
| 3,067,821 | A | 12/1962 | Crooks | |
| 3,089,724 | A * | 5/1963 | Crooks | 294/65.5 |
| 3,441,307 | A | 4/1969 | Farmer | |
| 3,520,359 | A * | 7/1970 | Ehrlich | 166/66.5 |
| 3,756,949 | A | 9/1973 | Schreurs | |
| 4,059,155 | A | 11/1977 | Greer | |
| 4,251,372 | A * | 2/1981 | Dolle | 210/222 |
| 5,217,610 | A * | 6/1993 | McClain et al. | 210/223 |
| 5,224,548 | A * | 7/1993 | Dankovich, II | 166/311 |
| 5,323,855 | A | 6/1994 | Evans | |
| 5,682,950 | A | 11/1997 | Bjornstad | |
| 5,944,100 | A | 8/1999 | Hipp | |
| 6,143,709 | A | 11/2000 | Carey | |
| 6,176,311 | B1 | 1/2001 | Ryan | |
| 6,216,787 | B1 | 4/2001 | Ruttley | |
| 6,234,183 | B1 | 5/2001 | Chan et al. | |
| 6,269,877 | B1 | 8/2001 | Zeer et al. | |
| 6,308,781 | B2 | 10/2001 | Ruttley | |

* cited by examiner

*Primary Examiner*—David Bagnell
*Assistant Examiner*—Shane Bomar
(74) *Attorney, Agent, or Firm*—Crowe & Dunlevy, P.C.

(57) ABSTRACT

A bailer is configured to remove particulate solids from fluid passing through the bailer. The bailer preferably includes a housing that includes an intake and an outlet to permit the flow if well fluids through the housing. The bailer also includes a magnetic plate that includes at least one aperture that provides a path for the fluid flow. The bailer optionally includes one or more elongate magnetic bars that extend along the longitudinal axis of the bailer housing. The bailer can be used in conjunction with other components in a downhole pumping system, a surface pumping system or a transport system.

7 Claims, 4 Drawing Sheets

MAGNETIC BAILER

FIELD OF THE INVENTION

This invention relates generally to the field of downhole pumping systems, and more particularly to an apparatus for filtering particulate solids.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the petroleum fluids from the subterranean reservoir to a storage facility on the surface. Each of the components in a submersible pumping system must be engineered to withstand the inhospitable downhole environment.

The efficient recovery of oil and gas from wells depends on maintaining clean formations, casing perforations, lines and pumping equipment. Despite these efforts, many oil wells produce fluids that contain large amounts of particulate solids that can damage downhole components. Various forms of iron sulfide are frequently present in produced fluids and are very hard (6–6.5 Mohs Scale). These hard particles exacerbate wear on downhole components as they are carried through the downhole pumping system with the produced fluid.

It would therefore be desirable to prevent iron sulfide particles from contacting expensive downhole components. Despite the recognition of these problems, prior art attempts to protect downhole components from iron sulfide have been unsuccessful. It is to these and other deficiencies in the prior art that the present invention is directed.

SUMMARY OF THE INVENTION

In a preferred embodiment, the present invention provides a bailer configured to remove particulate solids from fluid passing through the bailer. The bailer preferably includes a housing that includes an intake and an outlet to permit the flow if well fluids through the housing. The bailer also includes a magnetic plate that includes at least one aperture that provides a path for the fluid flow. The bailer optionally includes one or more elongate magnetic bars that extend along the longitudinal axis of the bailer housing.

The bailer can be used in conjunction with other components in a downhole pumping system. In a first preferred application, the bailer is installed in an offset intake pipe that extends through a packer. In a second preferred embodiment, the bailer is installed at the open end of a shroud that encapsulates the motor and pump assembly. In a third preferred embodiment, the bailer is positioned in the production tubing downstream from the pump assembly. In addition to downhole applications, the bailer of the present invention can be used with surface pumping operations and in fluid transport systems. These and various other features and advantages that characterize the present invention will be apparent from a reading and review of the following detailed description, appended claims and associated drawings.

DETAILED DESCRIPTION OF THE PREFERRED EMBODIMENT

Figure 1:
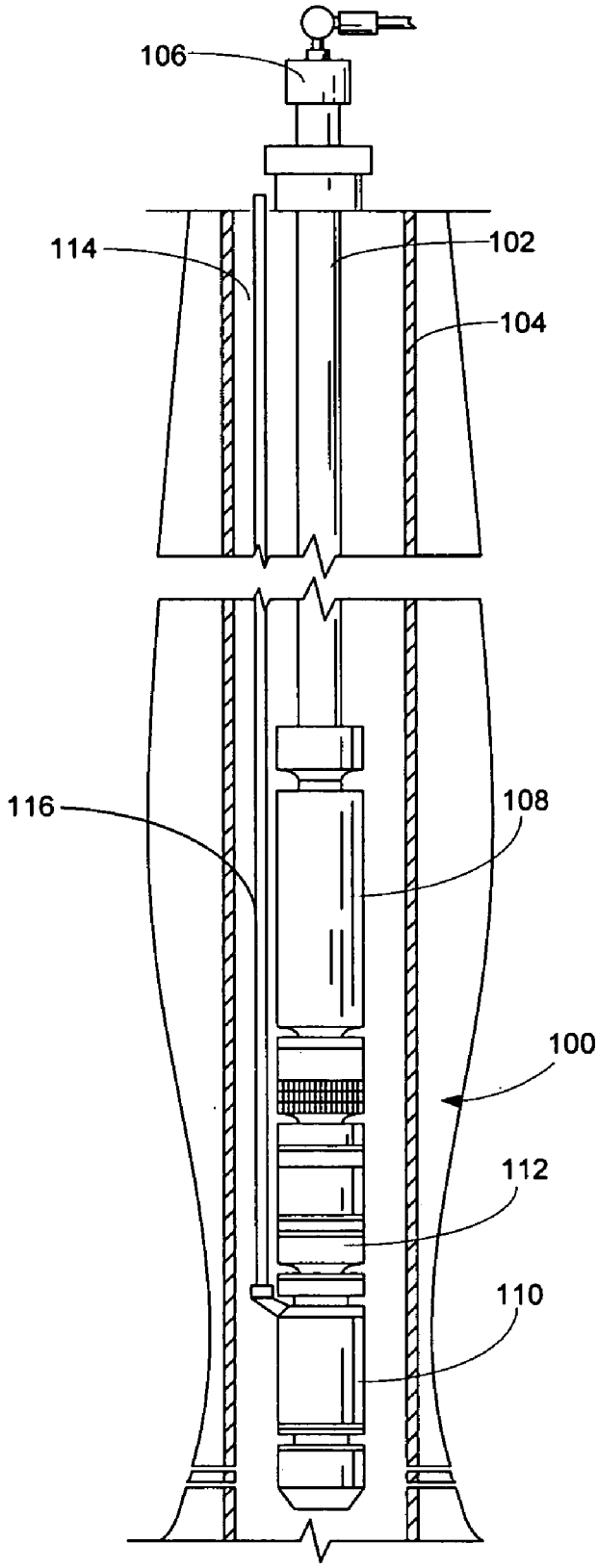
FIG. 1 is an elevational view of an electric submersible pumping system disposed in a wellbore constructed in accordance with a preferred embodiment of the present invention.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids.

The pumping system 100 preferably includes some combination of a pump assembly 108, a motor assembly 110 and a seal section 112. The seal section 112 prevents the entry of well bore fluids into the motor 110 and shields the motor assembly 110 from mechanical thrust produced by the pump assembly 108. The motor assembly 110 is provided with power from the surface by a power cable 114. Although only one pump assembly 108 and one motor assembly 110 are shown, it will be understood that additional pumps and motors can be connected within the pumping system 100 to meet the requirements of particular applications.

Figure 2:
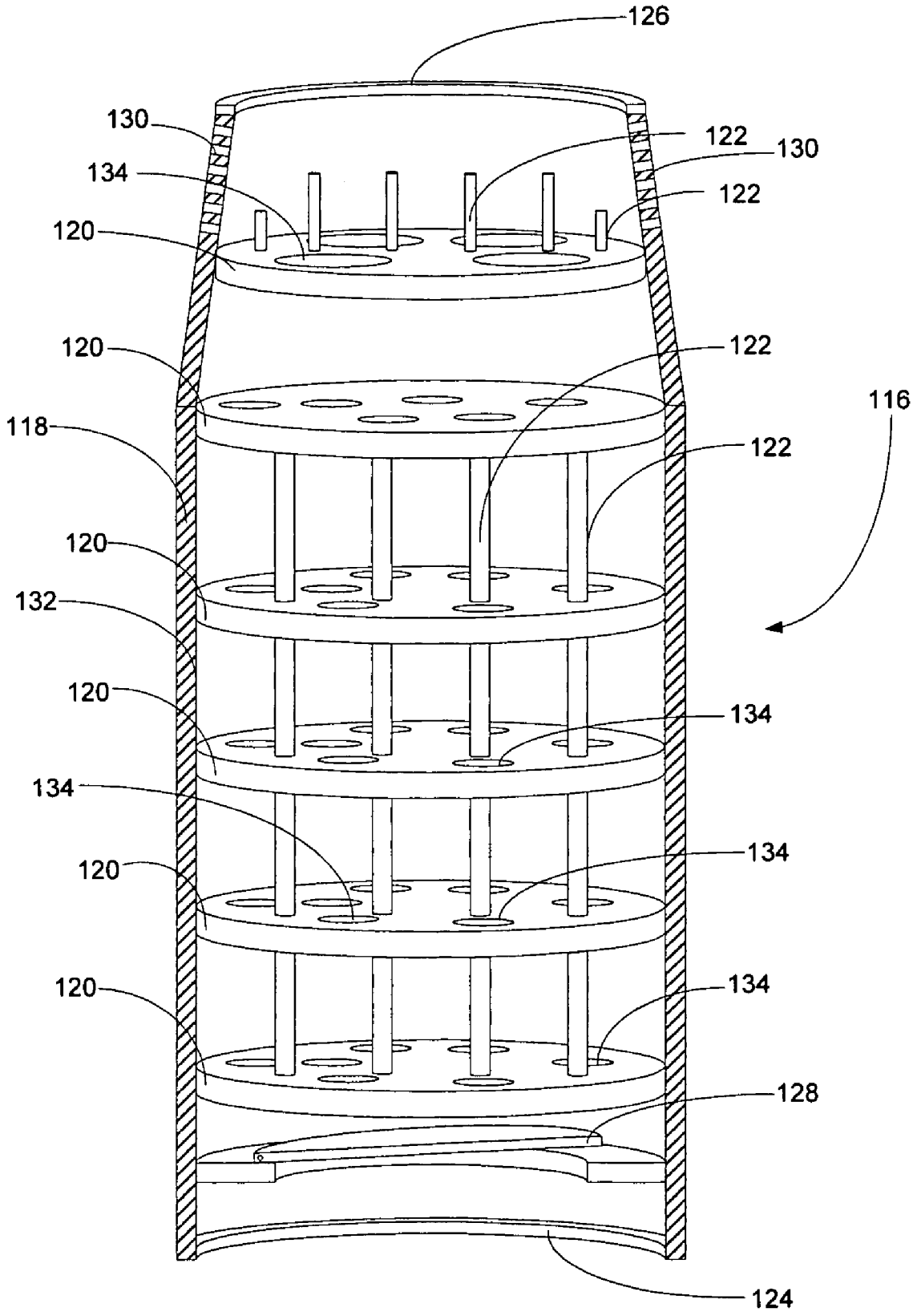
FIG. 2 is a perspective view of a magnetic bailer constructed in accordance with a preferred embodiment of the present invention.

Turning to FIG. 2, shown therein is a partial cutaway view of a bailer 116 constructed in accordance with a preferred embodiment of the present invention. The bailer 116 preferably includes a housing 118 (shown partially removed), one or more plates 120, one or more bars 122, an inlet 124 and an outlet 126. The bailer 116 optionally includes a check valve 128. Although a simple "flapper" style check valve 128 is depicted in FIG. 2, it will be understood that alternative valves could be employed alone or in combination with a flapper valve.

The housing 118 is preferably cylindrical and constructed from a rigid, corrosion-resistant material, such as steel or other suitable metal alloy. In a preferred embodiment, the portion of the housing proximate the outlet 126 tapers to a frustroconical end and includes vents 130 that permit increased flow through the bailer 116. Although the housing 118 is preferably sized and configured to be placed inside a larger fluid conduit, the housing 118 can also be configured for end-to-end attachment to equipment or fluid conduits of varying size.

In the presently preferred embodiment, the bailer 116 includes a plurality of plates 120. As shown in FIG. 2, the bailer 116 includes six plates 120 that are laterally oriented and connected at their peripheries to the inside surface 132 of the housing 118. In this way, each of the plates 120 is substantially perpendicular to the direction of fluid flow through the bailer 116. In an alternative embodiment, one or more of the plates 120 is connected to the inside surface 132 in a non-perpendicular relationship to the direction of fluid flow through the bailer 116. Although six plates 120 are depicted in FIG. 2, it will be understood that the use of fewer or greater numbers of plates 120 may be used to accommodate the requirements of specific applications. To permit fluid flow through the bailer 116, each plate 120 includes at least one aperture 134 that extends completely through the plate 120.

The bailer 116 also preferably includes one or more elongate bars 122 that extend substantially along the direction of fluid flow through the bailer 116. In a particularly preferred embodiment, the bars 122 extend through one or more plates 120. It will be understood that different numbers, sizes, shapes and configurations of bars 122 are encompassed within the scope of the present invention. As an example, the bailer 116 shown in FIG. 2 includes four lower bars 122 that extend through five lower plates 120 and six upper bars 122 that extend from an upper plate 120.

In presently preferred embodiments, one or more of the plates 120 and bars 122 is constructed from a material that exhibits a magnetic field. Suitable materials include rare-earth metals, including but not limited to neodymium iron boron and samarium cobalt alloys. In a particularly preferred embodiment, the plates 120 and bars 122 are nickel-plated to prevent corrosion. The collective and separate magnetic fields provided by the plates 120 and bars 122 attract magnetically permeable solids entrained in the stream of fluid passing through the bailer 116. In this way, iron sulfide particles are strained from the stream of well fluid and captured by the plates 120 and bars 122.

If magnetic, the plates 120 are preferably removably connected to the inside of the housing 118 through magnetic attraction. In the preferred embodiment, the bars 122 are held in position relative to the plates 120 through magnetic attraction. In this way, the plates 120 and bars 122 can be easily removed from the bailer 116 for cleaning, separation, modification or replacement.

Figure 3:
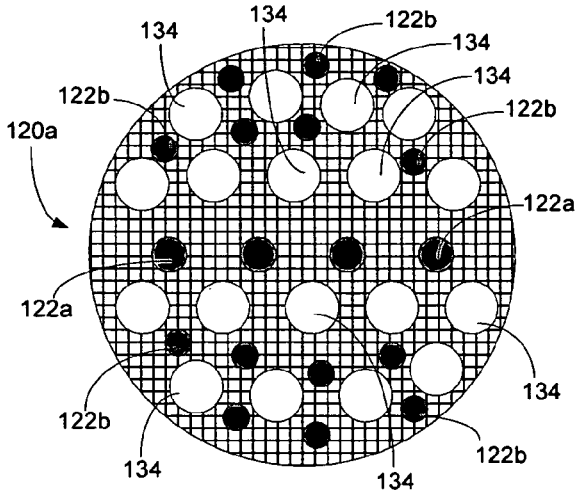
FIG. 3 is a top plan view of a first plate usable in the magnetic bailer of FIG. 2 constructed in accordance with a preferred embodiment of the present invention.

Turning to FIGS. 3–6, shown therein are top views of several plates 120 and bars 122 constructed in accordance with various preferred embodiments. FIG. 3 depicts a plate 120*a* through which four large diameter bars 122*a* and 14 small diameter bars 122*b* pass. The plate 120*a* also includes 18 apertures 134 that permit fluid flow across the plate 120. It will be understood that the determination of the size, number and configuration of bars 122 and apertures 134 on the plate 120*a* is made after considering a number of factors, including flow characteristics, pressure drop, pump requirements and fluid properties. For example, in the preferred embodiment, the plates 120 and bars 122 are preferably configured to produce magnetic fields and fluid flow profiles that are conducive to trapping magnetically permeable solids despite opposing velocity drag, buoyancy and pressure forces. As such, the size, number and configuration of bars 122 and apertures 134 are application specific and non-limiting to the preferred embodiment.

Figure 5:
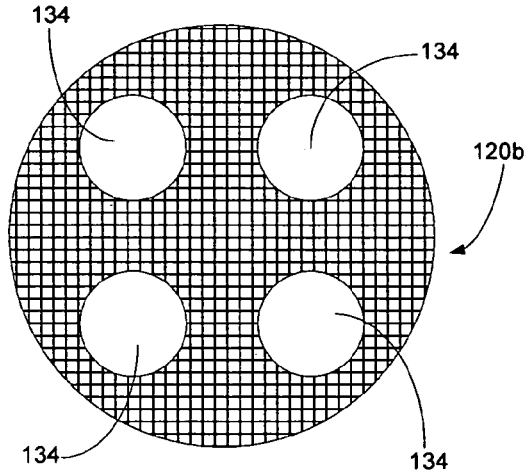
FIG. 5 is a top plan view of a third plate usable in the magnetic bailer of FIG. 2.
Figure 4:
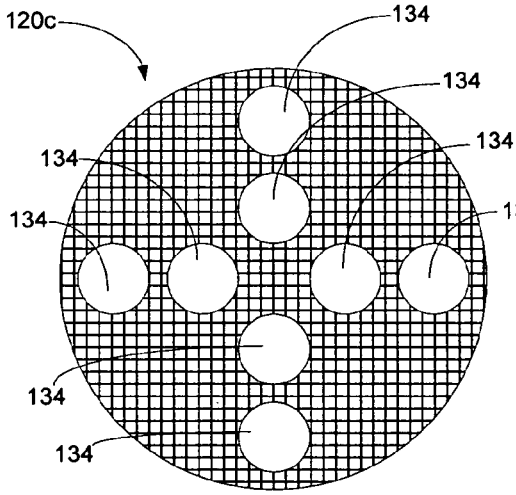
FIG. 4 is a top plan view of a second plate usable in the magnetic bailer of FIG. 2.
Figure 6:
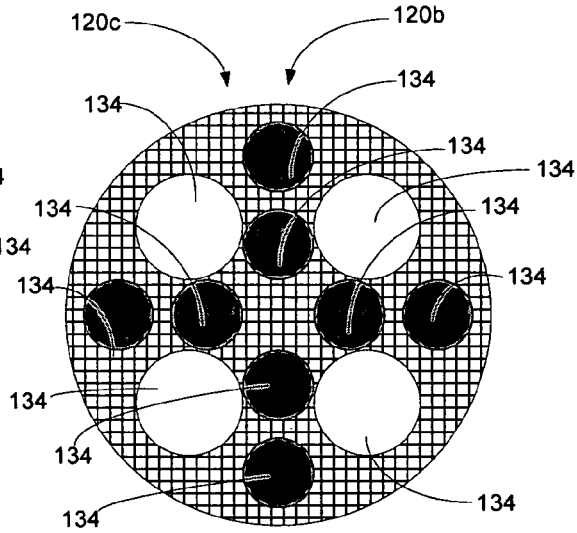
FIG. 6 is a top plan view showing the offset rotational position configuration of two plates useable in the magnetic bailer of FIG. 2.

FIGS. 4–6 respectively depict a lower magnetic plate 120*b*, an upper magnetic plate 120*c* and a preferred configuration of the lower magnetic plate 120*b* relative to the upper magnetic plate 120*c*. The lower magnetic plate 120*b* includes four large-sized apertures 134 in a "cross" pattern. The upper magnetic plate 120*c* includes eight medium-sized apertures 134 in a square orientation. It is believed that offsetting the apertures 134 in the lower plate 120*b* from the apertures 134 in the upper plate 120*c* enhances the performance of the bailer 116 by increasing the turbulence and residence time of fluids passing through the bailer 116. Although no bars 122 are shown in FIGS. 5–6, it will be understood that one or more bars 122 could be added to the plates 120 to adjust the performance of the bailer 116.

It will be understood that the bailer 116 is generally configured to remove particulate solids from fluids passing through the bailer 116. For the purposes of disclosing the preferred embodiment, the bailer 116 is described in conjunction with downhole equipment used to recover petroleum products from a subterranean formation. The bailer 116 is equally suited, however, for use in alternative applications or systems. For example, it may be desirable to use the bailer 116 in surface pumping systems, fluid transport systems and fluid storage systems.

Figure 7:
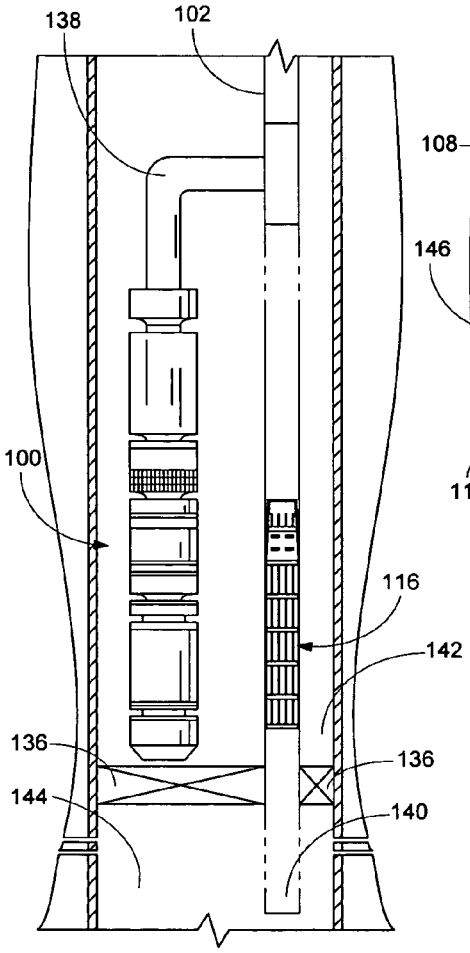
FIG. 7 is an elevational view of a first preferred configuration for using the magnetic bailer of FIG. 2.

In a first preferred application shown FIG. 7, the bailer 116 is used in combination with a downhole pumping system 100 that includes a packer 136, a y-tool 138 and an offset intake pipe 140. In this application, well fluids are drawn into an upper zone 142 from a lower zone 144 defined by the packer 136 through the offset intake pipe 140. The bailer 116 is operably positioned within the offset intake pipe 140 to remove iron sulfide particles entrained in well fluid drawn from the lower zone 144. Through use of the y-tool 138, the bailer 116 can be easily retrieved and deployed with wireline tools lowered through the production tubing 102.

Figure 8:
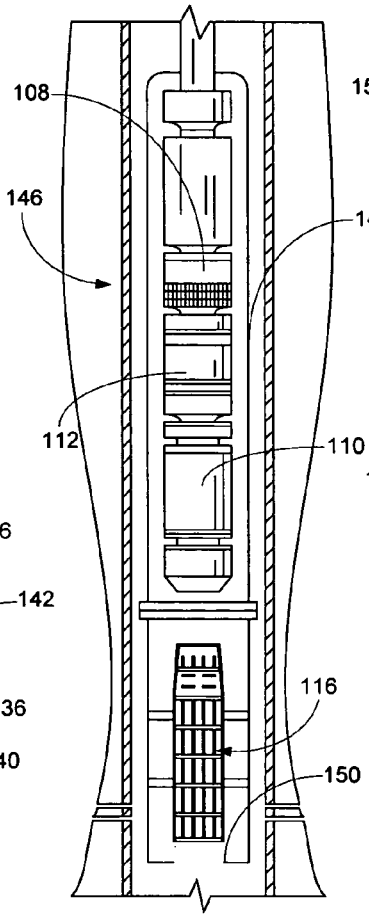
FIG. 8 is an elevational view of a second preferred configuration for using the magnetic bailer of FIG. 2.
Figure 9:
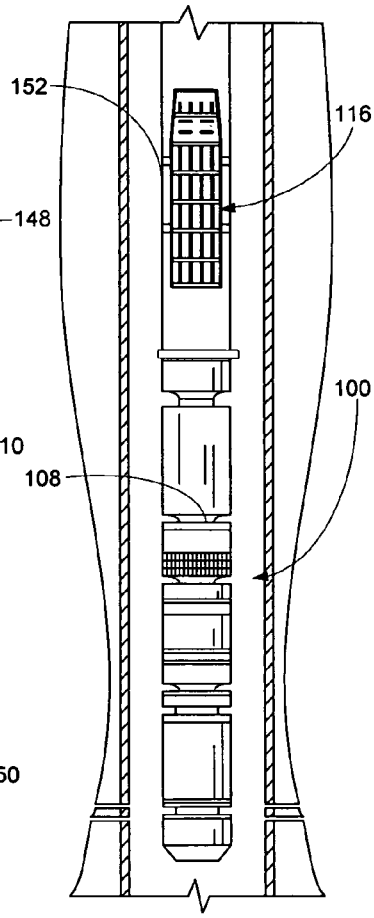
FIG. 9 is an elevational view of a third preferred configuration for using the magnetic bailer of FIG. 2.

In a second preferred application shown in FIG. 8, the bailer 116 is used in combination with an encapsulated pumping system 146. The encapsulated pumping system 146 preferably includes a shroud 148 that substantially encases the pump 108, motor 110 and seal 112. The shroud 148 preferably includes an open end 150 that conducts the flow of well fluid into the pump assembly 108. In this application, the bailer 116 is preferably located below the motor 110 toward the open end 150 of the shroud 148. In this way, iron sulfide particles are trapped in the bailer 116 before coming in contact with the motor 110, seal 112 or pump assembly 108.

In a third preferred embodiment, the bailer 116 is installed in a discharge conduit 152 above the pump assembly 108. The discharge conduit 152 is preferably connected between the pump assembly 108 and the production tubing 102 (not shown). Alternatively, the bailer 116 can be installed directly within the production tubing 102, thereby obviating the need for the separate discharge conduit 152. In this configuration, the bailer 116 removes solids, such as iron sulfide particles, before the well fluid reaches downstream components.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

The invention claimed is:

1. A bailer configured to remove particulate solids from fluid passing through the bailer, the bailer comprising:

a housing having an intake and an outlet to permit fluid flow through the housing; and a plurality of magnetic plates connected at their periphery to the housing and positioned in spaced-apart relationship between the housing intake and housing outlet, wherein each of the plurality of magnetic plates includes at least one aperture that provides a path for the fluid flow.

2. The bailer of claim 1, wherein each of the magnetic plates includes a plurality of apertures, wherein the plurality of apertures are sized and configured to control the velocity of the fluid flowing through and between the plurality of magnetic plates.

3. The bailer of claim 2, wherein the bailer includes an elongate magnetic bar connected to each of the plurality of magnetic plates.

4. The bailer of claim 3, wherein the bailer includes a plurality of elongate magnetic bars connected to the plurality of magnetic plates, wherein the plurality of elongate magnetic bars are configured in spaced-apart radial relationship with respect to the plurality of magnetic plates.

5. A bailer configured to remove particulate solids from fluid passing through the bailer, the bailer comprising:

a housing having an intake and an outlet to permit fluid flow through the housing;

a magnetic plate connected at its periphery to the housing, wherein the magnetic plate includes at least one aperture that provides a path for the fluid flow; and a check-valve proximate the housing intake.

6. A bailer configured to remove particulate solids from fluid passing through the bailer, the bailer comprising:

a housing having an intake and an outlet to permit fluid flow through the housing; and a magnetic plate connected at its periphery to the housing, wherein the magnetic plate includes at least one aperture that provides a path for the fluid flow and wherein the magnetic plate is removably connected to the housing with magnetic force.

7. A bailer configured to remove magnetically conductive particles from a well fluid stream, the bailer comprising:

a housing having an intake and an outlet to permit the passage of the well fluid stream through the bailer;

a perforated plate configured to adjust the flow profile of the well fluid stream, wherein the perforated plate is removably connected to the housing with magnetic force; and an elongate magnetic bar configured to attract the magnetically conductive particles in the well fluid stream.

* * * * *